US007755546B2

(12) United States Patent
Ishimiya

(10) Patent No.: US 7,755,546 B2
(45) Date of Patent: Jul. 13, 2010

(54) ANTENNA DEVICE AND MOBILE TERMINAL APPARATUS EQUIPPED WITH THE ANTENNA DEVICE

(75) Inventor: Katsunori Ishimiya, Tokyo (JP)

(73) Assignee: Sony Ericsson Mobile Communications Japan, Inc., Tokyo (JP)

( * ) Notice: Subject to any disclaimer, the term of this patent is extended or adjusted under 35 U.S.C. 154(b) by 334 days.

(21) Appl. No.: 11/322,339

(22) Filed: Jan. 3, 2006

(65) Prior Publication Data

US 2006/0158379 A1 Jul. 20, 2006

(30) Foreign Application Priority Data

Jan. 20, 2005 (JP) ..... 2005-013005

(51) Int. Cl.
*H01Q 1/24* (2006.01)

(52) U.S. Cl. ..... 343/702; 343/700 MS

(58) Field of Classification Search ..... 343/700 MS, 343/702, 846, 848
See application file for complete search history.

(56) References Cited

U.S. PATENT DOCUMENTS 6,054,954 A 4/2000 Eggleston et al.
6,600,450 B1 * 7/2003 Efanov et al. ..... 343/726
7,119,747 B2 * 10/2006 Lin et al. ..... 343/702
2004/0090376 A1 5/2004 Dai et al.
2004/0090377 A1 5/2004 Dai et al.
2004/0135729 A1 7/2004 Talvitie et al.
2004/0227665 A1 11/2004 Tai et al.
2004/0263396 A1 * 12/2004 Sung ..... 343/702
2007/0103371 A1 * 5/2007 Kim et al. ..... 343/702
2007/0132641 A1 * 6/2007 Korva et al. ..... 343/700 MS
2007/0139270 A1 * 6/2007 Takei et al. ..... 343/700 MS

FOREIGN PATENT DOCUMENTS

JP 08-204431 A 8/1996
JP 2002-043826 2/2002
WO WO 2004/097984 11/2004

OTHER PUBLICATIONS

EPO Search Report mailed Apr. 3, 2006.
Japanese Office Action issued Jun. 17, 2009 for corresponding Japanese Application No. 2005-013005.

* cited by examiner

*Primary Examiner*—HoangAnh T Le
(74) *Attorney, Agent, or Firm*—Rader, Fishman & Grauer PLLC

(57) ABSTRACT

There is provided an antenna device which includes: a loop antenna connected at one end to a feed point and connected at the other end to ground, and provided to correspond to a first frequency band; and at least one stub antenna provided in the form of extending a part of the loop antenna and provided to correspond to a second frequency band overlapping with a partial frequency band of the first frequency band to which the loop antenna corresponds.

14 Claims, 5 Drawing Sheets

ANTENNA DEVICE AND MOBILE TERMINAL APPARATUS EQUIPPED WITH THE ANTENNA DEVICE

CROSS REFERENCES TO RELATED APPLICATIONS

The present document contains subject matter related to Japanese Patent Application JP 2005-013005 filed in the Japanese Patent Office on Jan. 20, 2005, the entire contents of which being incorporated herein by reference.

BACKGROUND OF THE INVENTION

1. Field of the Invention

The present invention relates to an antenna device suitable for application to mobile terminal equipment such as mobile phones, PHS phones (PHS: Personal Handyphone System) and PDA equipment (PDA: Personal Digital Assistant) having communication functions, and relates to a mobile terminal apparatus equipped with such an antenna device. More particularly, the present invention relates to an antenna device having a widened frequency bandwidth and a multi-band construction, and to a mobile terminal apparatus equipped with such an antenna device.

2. Description of Related Art

Japanese Patent Application Publication (KOKAI) No. 2002-43826 (pages 3 to 4: FIG. 1) has heretofore disclosed a small-sized wide band antenna device which does not suffer a large fall in gain even when used in proximity to the human body. The antenna device has a rectangular full-wave loop antenna element installed in proximity to the base plate of a radio set, and the opposite ends of the loop antenna element are bent toward a feed point so as to produce a current distribution in which current becomes zero at the tip sections of the folded ends, and so as to concentrate current onto the loop antenna element. This construction reduces current components flowing on the base plate of the radio set, and suppresses the influence of the human body when the radio set is held by hand, as well as forms directivity characteristics corresponding to arrival waves.

SUMMARY OF THE INVENTION

If signals to be transmitted and received by the loop antenna are at low frequencies in the 800 MHz band, for example, the signals are long in wavelength, so that the length of the antenna itself needs to be increased. As a result, there is the problem that the loop antenna corresponding to the 800 MHz band is difficult to greatly widen in bandwidth.

In these days, telecommunications carriers in various regions of the world provide communications services using their respective allocated frequency bands such as the 800 MHz band, the 900 MHz band, the 1500 MHz band, the 1800 MHz band and the 1900 MHz band. In addition, to enable global roaming, it is preferable to provide a construction which enables one mobile phone to cope with a plurality of frequency bands (a multiband construction).

The present invention has been made in view of the above-mentioned problem, and the present invention is to provide an antenna device which makes it possible to realize a loop antenna having a greatly widened bandwidth and a multiband construction, as well as a mobile terminal apparatus equipped with such an antenna device.

To solve the above-mentioned problem, one embodiment of the present invention provides an antenna device which includes a loop antenna connected at one end to a feed point and connected at the other end to ground, and provided to correspond to a first frequency band, and at least one stub antenna provided in the form of extending a part of the loop antenna and provided to correspond to a second frequency band overlapping with a partial frequency band of the first frequency band to which the loop antenna corresponds.

To solve the above-mentioned problem, another embodiment of the present invention provides a mobile terminal apparatus. The mobile terminal apparatus includes: an antenna device including a loop antenna connected at one end to a feed point and connected at the other end to ground, and provided to correspond to a first frequency band, and at least one stub antenna provided in the form of extending a part of the loop antenna and provided to correspond to a second frequency band overlapping with a partial frequency band of the first frequency band to which the loop antenna corresponds; and a signal processing unit for performing signal processing on signals in a frequency band in which the first frequency band and the second frequency band are combined.

According to the embodiment of the present invention, the stub antenna which corresponds to the second frequency band overlapping with the partial frequency band of the first frequency band to which the loop antenna corresponds is added to the loop antenna, so that the frequency band to which the stub antenna corresponds can be set to a frequency band in which the frequency band to which the loop antenna itself corresponds is combined with the frequency band to which the stub antenna corresponds. Accordingly, it is possible to widen the frequency band to which the loop antenna corresponds.

In addition, an antenna device according to another embodiment of the present invention further includes, in addition to the above construction, a stub antenna provided in the form of extending a part of the loop antenna and provided to correspond to a third frequency band which differs from the first frequency band to which the loop antenna corresponds and the second frequency band to which the stub antenna corresponds.

In an antenna terminal apparatus according to another embodiment of the present invention, in addition to the above construction, the antenna device further includes at least one stub antenna provided in the form of extending a part of the loop antenna and provided to correspond to a third frequency band which differs from the first frequency band to which the loop antenna corresponds and the second frequency band to which the stub antenna corresponds.

According to the embodiments of the present invention, the stub antenna which corresponds to the third frequency band which differs from the first frequency band to which the loop antenna corresponds and the second frequency band to which the first stub antenna corresponds is added to the loop antenna. Accordingly, it allows a multiband construction capable of receiving signals in the first and second frequency bands to which the loop antenna and the stub antenna respectively correspond, as well as signals in the third frequency band to which the further added stub antenna corresponds.

BRIEF DESCRIPTION OF THE DRAWINGS

The present invention will become more readily appreciated and understood from the following detailed description of preferred embodiments of the present invention when taken in conjunction with the accompanying drawings, in which.

DETAILED DESCRIPTION OF THE EMBODIMENTS

The present invention can be applied to mobile phones.

[General Construction of Mobile Phone]

Figure 1:
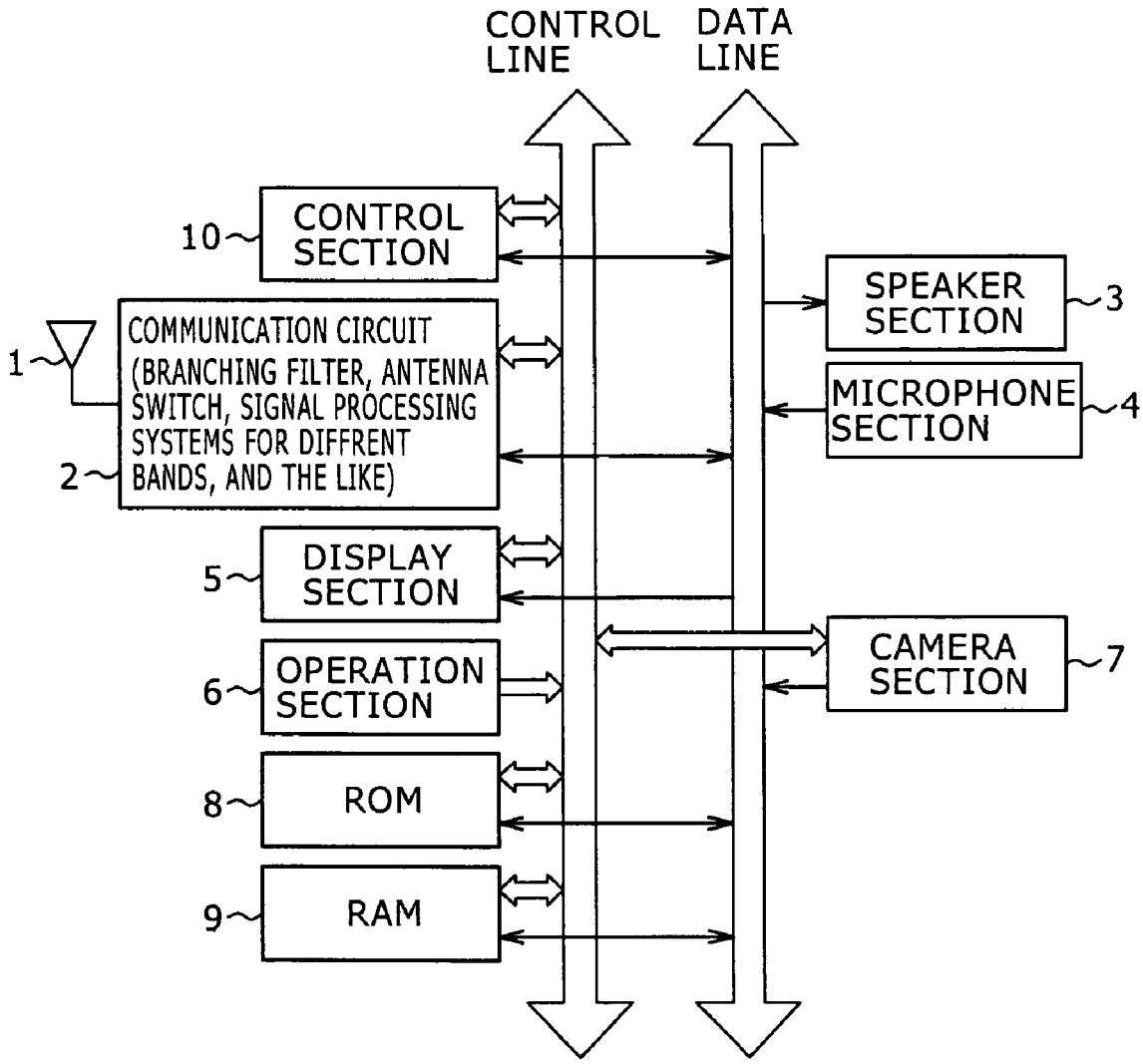
FIG. 1 is a block diagram of a mobile phone according to an embodiment to which the present invention is applied.

FIG. 1 shows a block diagram of a mobile phone according to an embodiment of the present invention. As shown in FIG. 1, the mobile phone according to the embodiment includes an antenna 1, a communication circuit 2, a speaker section 3, a microphone section 4 and a display section 5. The antenna 1 and the communication circuit 2 perform transmission and reception of data to and from a base station which is connected to a communications network of a mobile phone carrier. The speaker section 3 provides an audio output such as a ringtone, a received voice, the sound of a video file, or the sound of music data. The microphone section 4 collects a voice or the like to be transmitted. The display section 5 displays outgoing and incoming call numbers, the names of users who are sources and destinations, a log of incoming and outgoing calls and mobile mails, a telephone directory, an address book, a schedule book, the text of a sent or received mobile mail, and the like.

The mobile phone also includes an operation section 6, a camera section 7, a ROM 8, a RAM and a control section 10. The operation section 6 is provided with a plurality of keys for performing input and the like of desired phone numbers and characters. The camera section 7 captures still images and video images of desired subjects. The ROM 8 stores a communication processing program (communication program) and various other application programs for performing information processing on the mobile mail and the schedule book. The RAM 9 stores the log of incoming and outgoing calls and mobile mails, the body of the sent or received mobile mail, the telephone directory, the address book, the schedule book, and the like. The control section 10 controls the operation of the mobile phone on the basis of the communication processing program and the various other application programs.

[Construction of Antenna]

Figure 2:
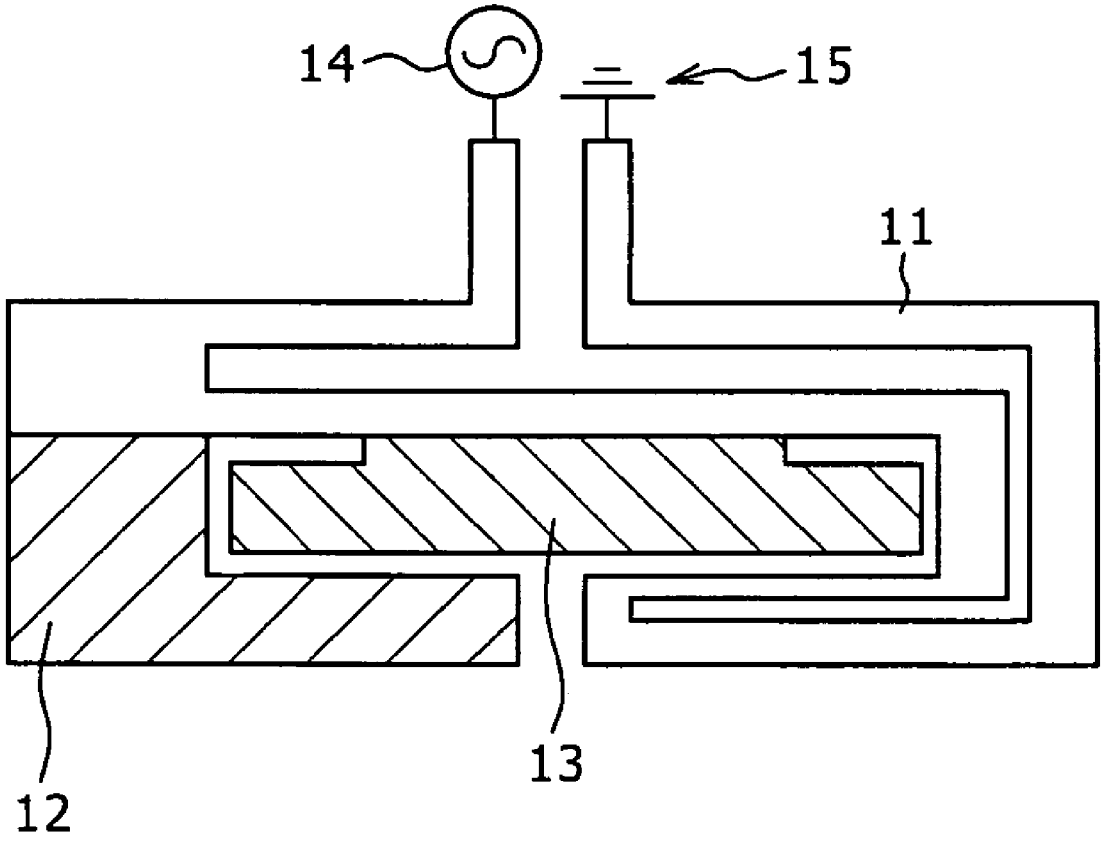
FIG. 2 is a schematic view showing the construction of an antenna provided in the mobile phone according to the embodiment of the present invention.

As shown in FIG. 2, the antenna 1 has a construction in which a loop antenna 11, an antenna 12 and an antenna 13 are integrally formed with a flexible printed circuit board. The loop antenna 11 is connected at one end to a feed point 14 and connected at the other end to ground 15, and corresponds to signals in the 800 MHz to 900 MHz band, for example. The antenna 12 (hereinafter referred to as the first stub antenna 12) is shown by top right oblique lines in FIG. 2 and corresponds to signals in the 900 MHz band. The antenna 13 (hereinafter referred to as the second stub antenna 13) is shown by top left oblique lines in FIG. 2 and corresponds to signals in the 1500 MHz band.

In this construction, if the first stub antenna 12 corresponding to low frequencies is provided in proximity to the ground 15, the amount of current flowing toward the ground 15 increases, so that the antenna characteristics of the first stub antenna 12 may be degraded. For this reason, one of the first and second stub antennas 12 and 13, i.e., the first stub antenna 12 corresponding to low frequencies (the 900 MHz band), is provided in proximity to the feed point 14.

In addition, in the above-mentioned preferred embodiment, the antennas 11 to 13 are formed with the flexible printed circuit board, but may also be formed by MIDs (Molded Interconnect Devices), sheet metal, or the like.

Figure 3A:
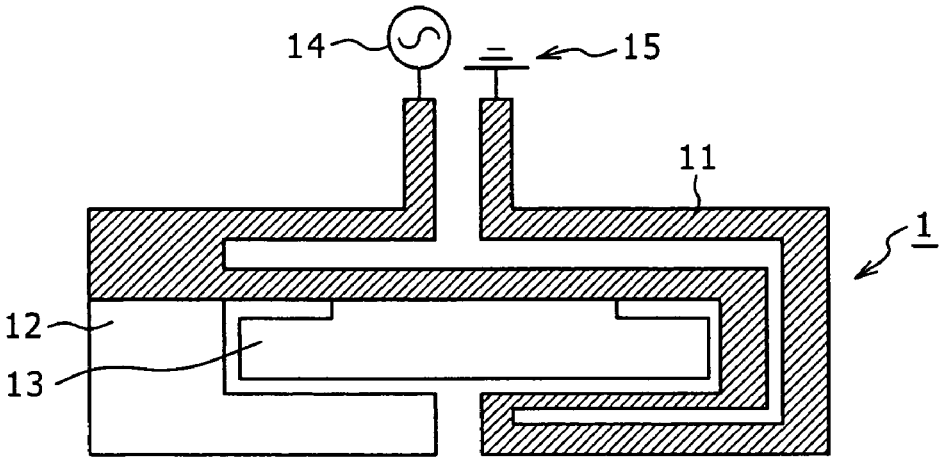
FIGS. 3A to 3C are schematic views for describing functions of the antenna provided in the mobile phone according to the embodiment of the present invention.
Figure 3B:
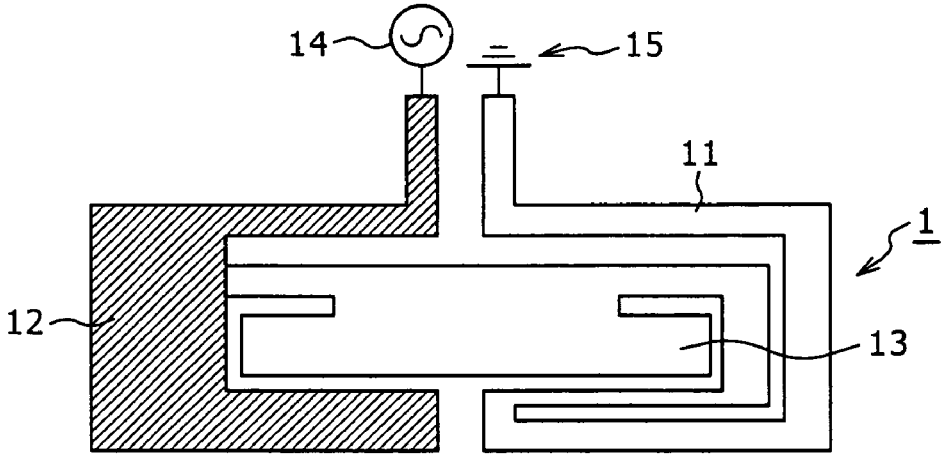
Figure 3C:
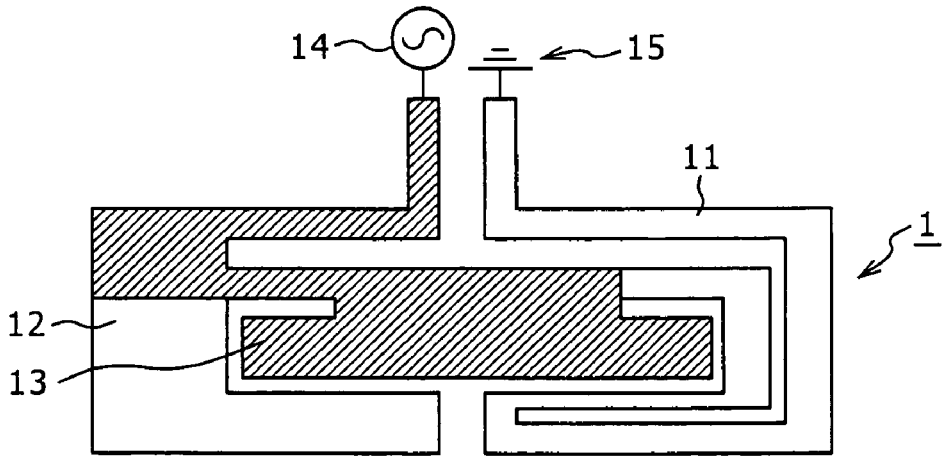

The antenna pattern shown in FIGS. 2 to 3C is merely one example, and may also be modified in accordance with desired antenna characteristics.

[Function of Antenna]

In the antenna 1, the section of the loop antenna 11 that is shaded in FIG. 3A (the section of the antenna 1 that excludes the first and second stub antenna 12 and 13) operates for signals in the 800 MHz to 900 MHz band, the section of the first stub antenna 12 that is shaded in FIG. 3B operates for signals in the 900 MHz band, and the section of the second stub antenna 13 that is shaded in FIG. 3C operates for signals in the 1500 MHz band.

Figure 4:
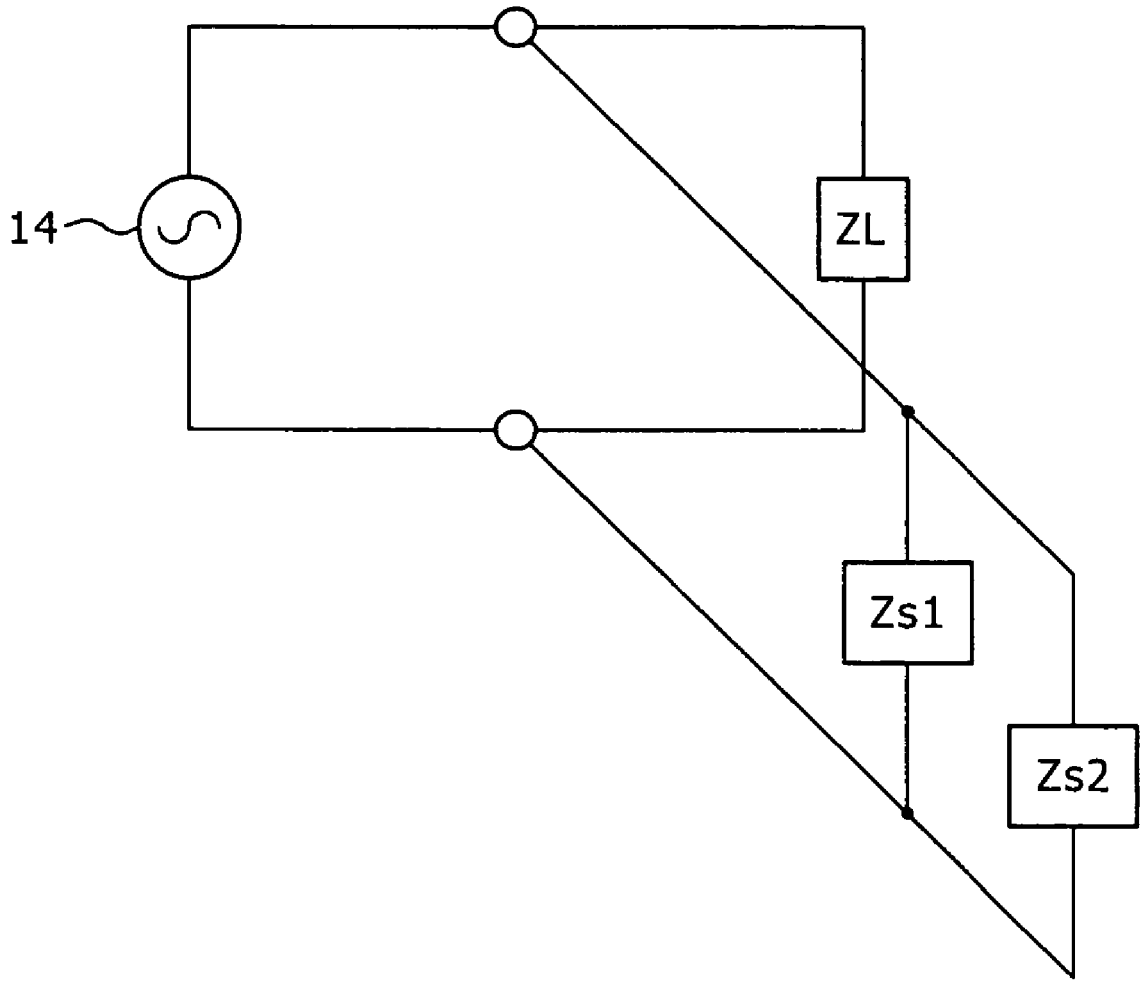
FIG. 4 is a diagram showing an equivalent circuit of the antenna provided in the mobile phone according to the embodiment of the present invention.

FIG. 4 is a diagram showing the antenna 1 in the form of an equivalent circuit. As can be seen from FIG. 4, the antenna 1 has an impedance ZL for the loop antenna 11, an impedance Zs1 for the first stub antenna 12, and an impedance Zs2 for the second stub antenna 13.

The loop antenna 11 corresponds to signals in the 800 MHz to 900 MHz band, and its transmission and reception function for signals in the 900 MHz band which is contained in the band to which the loop antenna 11 corresponds is complemented by the first stub antenna 12, so that the function of the loop antenna 11 to transmit and receive signals in the 800 MHz to 900 MHz band is improved (the bandwidth of the loop antenna 11 is widened).

In addition, the second stub antenna 13 corresponds to signals in the 1500 MHz band so as to realize a so-called multiband construction in which the loop antenna 11 and the first stub antenna 12 correspond to signals in the 800 MHz to 900 MHz band, while the second stub antenna 13 corresponds to signals in the 1500 MHz band.

Figure 5:
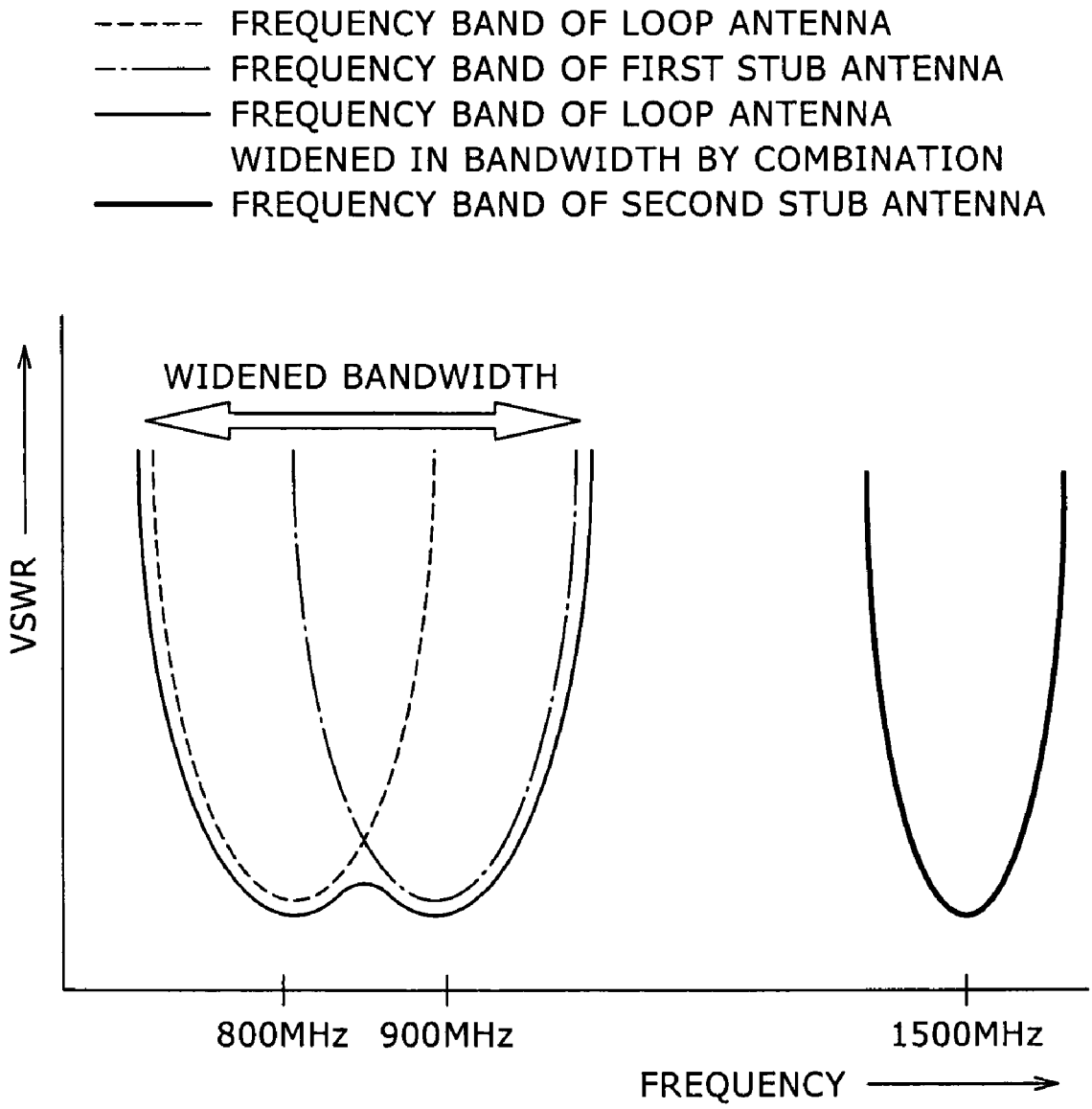
FIG. 5 is a frequency characteristic diagram of the antenna provided in the mobile phone according to the embodiment of the present invention.

FIG. 5 shows a frequency characteristic diagram of the antenna 1 which is fabricated and measured on an experimental basis by the applicant of the present application. The frequency characteristic diagram has a horizontal axis indicative of frequencies and a vertical axis indicative of voltage standing wave ratios (VSWR), and a dotted quadratic curve indicates a frequency characteristic based on only the loop antenna 11, a dot-dashed quadratic curve indicates a frequency characteristic based on only the first stub antenna 12, a solid-line quadratic curve indicates the frequency characteristic of the loop antenna 11 whose antenna function is improved by the first stub antenna 12, and a thick-line quadratic curve indicates a frequency characteristic based on only the second stub antenna 13.

As shown in FIG. 5, by adding the first stub antenna 12 to the loop antenna 11, it is possible to improve the transmission and reception function for signals in the 900 MHz band, so that it is possible to largely widen the bandwidth of the loop antenna 11.

In addition, by adding the second stub antenna 13 to the loop antenna 11, it is possible to realize a multiband construction capable of coping with signals in the 800 MHz to 900 MHz band and signals in the 1500 MHz band.

[Transmission and Reception Processing for Signals]

Signals received by the antenna 1 are separated into signals in the 800 MHz to 900 MHz band and signals in the 1500

MHz band by a branching filter which is provided in the communication circuit 2 of the mobile phone. These signals are switched by an antenna switch and are supplied to signal processing systems for the respective bands, in each of which the supplied signals are subjected to appropriate signal processing.

During transmission of signals in the 800 MHz to 900 MHz band, signals from the signal processing system for the 800 MHz to 900 MHz band are selected by the antenna switch, while during transmission of signals in the 1500 MHz band, signals from the signal processing system for the 1500 MHz band are selected by the antenna switch. The signals selected in this manner are transmitted to a base station via the branching filter and the antenna 1.

ADVANTAGE OF THE EMBODIMENT

As is apparent from the foregoing description, the mobile phone according to the embodiment of the present invention has a construction which includes the loop antenna 11 corresponding to signals in the 800 MHz to 900 MHz band, and the first antenna 12 complementing the transmission and reception function for signals in the 900 MHz band in the antenna characteristic of the loop antenna 11, as well as the second stub antenna 13 corresponding to signals in the 1500 MHz band. Accordingly, it is possible to realize a great widening of the bandwidth of the loop antenna 11, and it is also possible to realize a multiband construction capable of coping with signals in the 800 MHz to 900 MHz band and signals in the 1500 MHz band.

There is a case where when a user holds a mobile phone by hand or to his/her ear, a frequency shift occurs in a transmitted or received signal. However, the mobile phone according to the preferred embodiment can be widened in its corresponding frequency as mentioned previously, so that even if such a frequency shift occurs, the mobile phone can fully cope with the frequency shift and perform satisfactory transmission and reception of signals.

In addition, since the first stub antenna 12 corresponding to a low frequency of 900 MHz is provided in proximity to the feed point 14, it is possible to prevent the problem that if the first stub antenna 12 is provided in proximity to the ground 15, the amount of current flowing toward the ground 15 increases and the antenna characteristics of the first stub antenna 12 are degraded. Accordingly, it is possible to satisfactorily maintain the antenna characteristic of the first stub antenna 12.

In addition, since the antennas 11 to 13 are integrally formed by the flexible printed circuit board, it is possible to improve the degree of freedom of design of the mobile phone, and it is also possible to promote ease of manufacturing of the mobile phone.

[Modification]

In the above description of the preferred embodiment, the frequencies of signals to be transmitted and received by the antenna device have been referred to as the 800 MHz to 900 MHz band and the 1500 MHz band, but such frequencies may be appropriately changed according to the frequencies of signals to be transmitted and received, for example, so that signals in the 1800 MHz or 1900 MHz band can be transmitted and received instead of signals in the 1500 MHz band.

In the above description of the preferred embodiment, reference has been made to an example in which the present invention is applied to mobile phones, but the present invention may also be applied to PHS phones (PHS: Personal Handyphone System) and PDA equipment (PDA: Personal Digital Assistant) as well as other terminal equipment such as notebook personal computers having communication functions.

According to the present invention, a stub antenna which corresponds to a second frequency band overlapping with a first frequency band to which a loop antenna corresponds is added to the loop antenna, so that the frequency band to which the stub antenna corresponds can be set to a frequency band in which the frequency band to which the loop antenna itself corresponds is combined with the frequency band to which the stub antenna corresponds. Accordingly, it is possible to widen the frequency band to which the loop antenna corresponds.

In addition, since it is possible to widen the frequency band to which the loop antenna corresponds, it is possible to fully cope with a frequency shift which occurs in a transmitted or received signal when the mobile phone is held by hand or to the ear, so that it is possible to perform satisfactory transmission and reception of signals.

In addition, since the stub antenna is provided in proximity to a feed point, it is possible to prevent the problem that if the stub antenna is provided in proximity to ground, the amount of current flowing toward ground increases and the antenna characteristics of the stub antenna are degraded. Accordingly, it is possible to satisfactorily maintain the antenna characteristic of the stub antenna.

In addition, a further stub antenna which corresponds to a third frequency band which differs from the first frequency band to which the loop antenna corresponds and the second frequency band to which the above-mentioned stub antenna corresponds is added to the loop antenna, so that it is possible to realize a multiband construction capable of receiving signals in the first and second frequency bands to which the loop antenna and the stub antenna respectively correspond, as well as signals in the third frequency band to which the further added stub antenna corresponds.

In addition, since the loop antenna and the stub antennas are integrally formed by a flexible printed circuit board, it is possible to improve the degree of freedom of design of the antenna device and mobile terminal equipment, and it is also possible to promote ease of manufacturing of the antenna device and mobile terminal equipment.

The above-mentioned preferred embodiments are merely disclosed as one example of the present invention. It goes without saying that the present invention is not limited to the above-mentioned preferred embodiments, and can of course be modified in various ways other than the above-mentioned preferred embodiments according to design and the like without departing from technical concepts according to the present invention.

What is claimed is:

1. An antenna device comprising:

a loop antenna connected at one end to a feed point and connected at the other end to ground, and provided to correspond to a first frequency band; and a stub antenna provided in the form of extending a part of said loop antenna in an outside direction of a loop enclosed by said loop antenna and provided to correspond to a second frequency band, wherein said second frequency band is different than said first frequency band, wherein said second frequency band partially overlaps said first frequency band, wherein said loop antenna and said stub antenna are on the same plane, and wherein said stub antenna is formed in closer proximity to said feed point than to said ground.

2. The antenna device according to claim 1, wherein said second frequency band is centered at a frequency which is higher than a frequency at which said first frequency band is centered.

3. The antenna device according to claim 1 further comprising:

a second stub antenna provided in the form of extending a part of said loop antenna and provided to correspond to a third frequency band which differs from said first frequency band to which said loop antenna corresponds and said second frequency band to which said stub antenna corresponds.

4. The antenna device according to claim 3, wherein said second stub antenna operates for signals in the 1500 MHz band.

5. The antenna device according to claim 3, wherein said second stub antenna is on the same plane as said loop antenna and said stub antenna.

6. The antenna device according to claim 1, wherein said loop antenna and said stub antenna are formed with a flexible printed circuit board.

7. The antenna device according to claim 1, wherein said loop antenna operates for signals in the 800 MHz to the 900 MHz band.

8. The antenna device according to claim 1, wherein said stub antenna operates for signals in the 900 MHz band.

9. A mobile terminal apparatus comprising:

an antenna device including:

a loop antenna connected at one end to a feed point and connected at the other end to ground, and provided to correspond to a first frequency band, and a stub antenna provided in the form of extending a part of said loop antenna in an outside direction of a loop enclosed by said loop antenna and provided to correspond to a second frequency band; and a signal processing unit for performing signal processing on signals in a frequency band in which said first frequency band and said second frequency band are combined, wherein said second frequency band is different than said first frequency band, wherein said second frequency band partially overlaps said first frequency band, wherein said loop antenna and said stub antenna are on the same plane, and wherein said stub antenna is formed in closer proximity to said feed point than to said ground.

10. The mobile terminal apparatus according to claim 9, wherein said second frequency band is centered at a frequency which is higher than a frequency at which said first frequency band is centered.

11. The mobile terminal apparatus according to claim 9, wherein:

said antenna device further includes a second stub antenna provided in the form of extending a part of said loop antenna and provided to correspond to a third frequency band which differs from said first frequency band to which said loop antenna corresponds and said second frequency band to which said stub antenna corresponds; and further comprising:

signal processing means for performing signal processing on a signal in said third frequency band;

branching filter means for performing separation processing on a signal in said frequency band in which said first frequency band and said second frequency band respectively received by said loop antenna and said stub antenna are combined, and a signal in said third frequency band received by said second stub antenna; and switching means for performing, during reception, switching between said signal in said combined frequency band and said signal in said third frequency band, which bands are separated by said branching filter means, and supplying each of said signals to a respective one of said signal processing means, and for performing, during transmission, switching between said signals in said frequency bands processed by said respective signal processing means and supplying each of said signals to said antenna device via said branching filter means.

12. The antenna device according to claim 11, wherein said second stub antenna is on the same plane as said loop antenna and said stub antenna.

13. The mobile terminal apparatus according to claim 9, wherein said loop antenna and said stub antenna of said antenna device are formed with a flexible printed circuit board.

14. The mobile terminal apparatus according to claim 9, wherein:

said antenna device further includes a second stub antenna provided in the form of extending a part of said loop antenna and provided to correspond to a third frequency band which differs from said first frequency band to which said loop antenna corresponds and said second frequency band to which said stub antenna corresponds; and further comprising:

a signal processor for performing signal processing on a signal in said third frequency band;

a branching filter for performing separation processing on a signal in said frequency band in which said first frequency band and said second frequency band respectively received by said loop antenna and said stub antenna are combined, and a signal in said third frequency band received by said second stub antenna; and a switch for performing, during reception, switching between said signal in said combined frequency band and said signal in said third frequency band, which bands are separated by said branching filter, and supplying each of said signals to a respective one of said signal processors, and for performing, during transmission, switching between said signals in said frequency bands processed by said respective signal processors and supplying each of said signals to said antenna device via said branching filter.

* * * * *